US006957998B2

(12) United States Patent
Togawa

(10) Patent No.: US 6,957,998 B2
(45) Date of Patent: Oct. 25, 2005

(54) POLISHING APPARATUS

(75) Inventor: Tetsuji Togawa, Chigasaki (JP)

(73) Assignee: Ebara Corporation, Tokyo (JP)

( * ) Notice: Subject to any disclaimer, the term of this patent is extended or adjusted under 35 U.S.C. 154(b) by 445 days.

(21) Appl. No.: 10/097,568

(22) Filed: Mar. 15, 2002

(65) Prior Publication Data

US 2002/0132559 A1 Sep. 19, 2002

(30) Foreign Application Priority Data

Mar. 16, 2001 (JP) ..... 2001-077133

(51) Int. Cl.[7] ..... B24B 49/00; B24B 51/00

(52) U.S. Cl. ..... 451/8; 451/41; 451/288; 451/388; 451/398

(58) Field of Search ..... 451/8, 36, 41, 451/287, 288, 388, 398

(56) References Cited

U.S. PATENT DOCUMENTS 5,762,539 A * 6/1998 Nakashiba et al. ..... 451/41
5,851,140 A * 12/1998 Barns et al. ..... 451/288
5,913,714 A 6/1999 Volodarsky et al.
5,957,751 A 9/1999 Govzman et al.
6,019,670 A 2/2000 Cheng et al.
6,135,858 A 10/2000 Takahashi
6,328,629 B1 * 12/2001 Togawa et al. ..... 451/8

OTHER PUBLICATIONS

Patent Abstracts of Japan, vol. 1998, No. 14, Dec. 31, 1998 & JP 10 230450 A (Ebara Corp), Sep. 2, 1998.

* cited by examiner

*Primary Examiner*—Timothy V. Eley
(74) *Attorney, Agent, or Firm*—Wenderoth, Lind & Ponack, L.L.P.

(57) ABSTRACT

A polishing apparatus for polishing a substrate comprises a polishing table having a polishing surface, and a substrate holding apparatus for holding a substrate to be polished and pressing the substrate against the polishing surface. The substrate holding apparatus comprises a vertically movable top ring body for holding a substrate, and a fluid supply source for supplying a fluid under a positive pressure or a negative pressure to a hermetically sealed chamber which is defined in the top ring body so as to control pressure under which the substrate is pressed against the polishing surface. The substrate holding apparatus further comprises a measuring device disposed in a fluid passage interconnecting the hermetically sealed chamber and the fluid supply source for measuring a flow rate of the fluid in the fluid passage.

10 Claims, 6 Drawing Sheets

POLISHING APPARATUS

BACKGROUND OF THE INVENTION

1. Field of the Invention

The present invention relates to a substrate holding apparatus for holding a substrate to be polished and pressing the substrate against a polishing surface, and more particularly to a substrate holding apparatus for holding a substrate such as a semiconductor wafer in a polishing apparatus for polishing the substrate. The present invention also relates to a dressing apparatus for dressing a polishing surface by bringing a dressing member in sliding contact with the polishing surface, and more particularly to a dressing apparatus in the above polishing apparatus.

2. Description of the Related Art

In a manufacturing process of a semiconductor device, a thin film is formed on a semiconductor device, and then micromachining processes, such as patterning or forming holes, are performed. Thereafter, these processes are repeated to form thin films on the semiconductor device. Recently, semiconductor devices have become more integrated, and structure of semiconductor elements has become more complicated. In addition, a number of layers in multilayer interconnections used for a logical system has been increased. Therefore, irregularities on a surface of the semiconductor device are increased, so that a step height on the surface of the semiconductor device becomes larger.

When irregularities on the surface of the semiconductor device are increased, the following problems arise. Thickness of a film formed in a portion having a step is relatively small. An open circuit is caused by disconnection of interconnections, or a short circuit is caused by insufficient insulation between the layers. As a result, good products cannot be obtained, and yield is reduced. Further, even if a semiconductor device initially works normally, reliability of the semiconductor device is lowered after long-term use. At a time of exposure in a lithography process, if an irradiation surface has irregularities, then a lens unit in an exposure system is locally unfocused. Therefore, if irregularities on the surface of the semiconductor device are increased, then it is difficult to form a fine pattern on the semiconductor device.

Thus, in a manufacturing process of a semiconductor device, it is increasingly important to planarize a surface of the semiconductor device. The most important one of planarizing technologies is chemical mechanical polishing (CMP). In chemical mechanical polishing using a polishing apparatus, while a polishing liquid containing abrasive particles such as silica ($SiO_2$) therein is supplied onto a polishing surface such as a polishing pad, a substrate such as a semiconductor wafer is brought into sliding contact with the polishing surface, so that the substrate is polished.

This type of polishing apparatus comprises a polishing table having a polishing surface constituted by a polishing pad (or a fixed abrasive), and a substrate holding apparatus, such as a top ring or a carrier head, for holding a semiconductor wafer. When a semiconductor wafer is polished with this type of polishing apparatus, the semiconductor wafer is held by the substrate holding apparatus and pressed against the polishing table under a predetermined pressure. At this time, the polishing table and the substrate holding apparatus are moved relatively to each other to bring the semiconductor wafer into sliding contact with the polishing surface, so that a surface of the semiconductor wafer is polished to a flat mirror finish.

When the semiconductor wafer is polished with such a polishing apparatus, a polishing liquid or ground-off particles of semiconductor material are attached to the polishing surface (polishing pad), resulting in a change in properties of the polishing pad and deterioration in polishing performance. Therefore, if an identical polishing pad is repeatedly used for polishing semiconductor wafers, problems such as lowered polishing rate and uneven polishing are caused. Therefore, a dressing apparatus (dresser) is provided adjacent to the polishing apparatus to regenerate the surface of the polishing pad which has deteriorated due to polishing. In a dressing process, while a dressing member attached to a lower surface of the dresser is pressed against the polishing pad (polishing surface) on the polishing table, the polishing table and the dresser are independently rotated to remove the polishing liquid and the ground-off particles of the semiconductor material which are attached to the polishing surface, and to flatten and dress the polishing surface. The dressing member generally comprises a dressing surface on which diamond particles are electrodeposited, and the dressing surface is brought into contact with the polishing surface. This dressing process is also referred to as a conditioning process.

In the above polishing apparatus, if relative pressure between a semiconductor wafer which is being polished and the polishing surface of the polishing pad is not uniform over an entire surface of the semiconductor wafer, then the semiconductor wafer may be insufficiently polished or may be excessively polished depending on pressure applied to the semiconductor wafer. Therefore, it has been attempted to define a hermetically sealed chamber within a substrate holding apparatus with an elastic membrane, and supply a fluid under a predetermined pressure to the hermetically sealed chamber for thereby controlling pressure imposed on a semiconductor wafer by the substrate holding apparatus.

In the process of dressing the polishing surface on the polishing table with the dresser, since the polishing surface is scraped by a dressing action, if a dressing load under which the dressing member is pressed against the polishing surface is large, then service life of the polishing pad (or fixed abrasive) is shortened, and a cost of the polishing apparatus is increased. Therefore, it has also been attempted to define a hermetically sealed chamber within the dresser with an elastic membrane, and supply a fluid under a predetermined pressure to the hermetically sealed chamber for thereby controlling a dressing load.

However, in a case of the substrate holding apparatus for polishing a semiconductor wafer while controlling pressure applied to the semiconductor wafer, if a leakage occurs from the hermetically sealed chamber due to a crack or a break in the elastic membrane, then pressure in the hermetically sealed chamber may not be kept at a preset level, and the semiconductor wafer being polished may be broken.

Similarly, in a case of the dresser for dressing the polishing surface while controlling the dressing load, if a leakage occurs from the hermetically sealed chamber and pressure in the hermetically sealed chamber is not kept at a preset level, then the polishing surface may be damaged and the dresser itself may be broken due to an uneven dressing load.

SUMMARY OF THE INVENTION

The present invention has been made in view of the above drawbacks in the conventional technology. It is therefore an object of the present invention to provide a substrate holding apparatus which can safely and accurately control a pressure applied to a substrate, and a dressing apparatus which can safely and accurately control a dressing load applied to a polishing surface.

Another object of the present invention is to provide a polishing apparatus which has such a substrate holding apparatus or a dressing apparatus.

In order to achieve the above objects, according to a first aspect of the present invention, there is provided a substrate holding apparatus for holding a substrate to be polished and pressing the substrate against a polishing surface, the substrate holding apparatus comprising: a vertically movable top ring body for holding a substrate; a hermetically sealed chamber defined in the top ring body; a fluid supply source for supplying a fluid under a positive pressure or a negative pressure to the hermetically sealed chamber to control pressure under which the substrate is pressed against the polishing surface; a fluid passage interconnecting the hermetically sealed chamber and the fluid supply source; and a measuring device disposed in the fluid passage for measuring a flow rate in the fluid passage.

According to a second aspect of the present invention, there is provided a polishing method for polishing a substrate, comprising: pressing a substrate against a polishing surface provided on a polishing table with a top ring; supplying a fluid under a positive pressure or a negative pressure to a hermetically sealed chamber which is defined in the top ring to control pressure under which the substrate is pressed against the polishing surface; measuring a flow rate of fluid in a fluid passage through which the fluid flows; and detecting leakage from the hermetically sealed chamber based on the measured flow rate. In this method, a process of polishing the substrate is preferably stopped when leakage from the hermetically sealed chamber is detected or the substrate is slipped out of the top ring.

According to the present invention, by measuring the flow of the pressurized fluid, it is possible to detect leakage from the hermetically sealed chamber for thereby detecting a break of an elastic membrane which defines the hermetically sealed chamber, or an assembling failure of the top ring. Since pressure in the hermetically sealed chamber can be kept at a preset level, the possibility of damage to the substrate can be reduced. The measuring device can detect not only leakage from the hermetically sealed chamber, but also a dislodgment of the substrate from a lower surface of the top ring during a polishing process. Therefore, the possibility of damage to the substrate can further be reduced.

According to a third aspect of the present invention, there is provided a dressing apparatus for dressing a polishing surface of a polishing table for polishing a surface of a substrate, the dressing apparatus comprising: a vertically movable dresser body; a dresser plate disposed vertically movably with respect to the dresser body; a dressing member supported by the dresser plate; a hermetically sealed chamber provided between the dresser body and the dresser plate, at least part of the hermetically sealed chamber being defined by an elastic membrane; a fluid supply source for supplying a fluid under a positive pressure or a negative pressure to the hermetically sealed chamber to control a dressing load; a fluid passage interconnecting the hermetically sealed chamber and the fluid supply source; and a measuring device disposed in the fluid passage for measuring a flow rate in the fluid passage.

According to a fourth aspect of the present invention, there is provided a method of dressing a polishing surface of a polishing table for polishing a surface of a substrate with a dresser, comprising: supplying a fluid under a positive pressure or a negative pressure to a hermetically sealed chamber which is defined in the dresser to control a dressing load; measuring a flow rate of the fluid in a fluid passage through which the fluid flows; and detecting leakage from the hermetically sealed chamber based on the measured flow rate. In this method, a process of dressing the polishing surface is preferably stopped when leakage from the hermetically sealed chamber is detected.

According to the present invention, by measuring flow of pressurized fluid, it is possible to detect leakage from the hermetically sealed chamber for thereby detecting a break of an elastic membrane which defines the hermetically sealed chamber, or an assembling failure of the dresser. Since pressure in the hermetically sealed chamber can be kept at a preset level, the polishing surface is prevented from being damaged by an unbalanced dressing load, and the dresser itself is prevented from being broken.

According to a preferred aspect of the present invention, the substrate holding apparatus further comprises at least one hermetically sealed chamber defined in the top ring body. Furthermore, the dressing apparatus further comprises at least one hermetically sealed chamber, and at least part of the hermetically sealed chamber is defined by an elastic membrane. In these cases, the substrate holding apparatus or the dressing apparatus further comprises at least one fluid passage so as to correspond to the at least one hermetically sealed chamber, and at least one measuring device disposed in the at least one fluid passage. With this arrangement, it is possible to immediately judge which one of the hermetically sealed chambers in the top ring or the dresser has caused leakage, and hence an operator can work on only necessary members quickly.

At least part of the hermetically sealed chamber in the top ring body may be constructed of the substrate. When at least part of the hermetically sealed chamber in the top ring is constructed of the substrate, not only leakage from the hermetically sealed chamber, but also a dislodgment of the substrate from the top ring can be detected based on a flow rate measured by the measuring device.

According to a fifth aspect of the present invention, there is provided a polishing apparatus for polishing a substrate, comprising: a polishing table having a polishing surface; and the above substrate holding apparatus. According to a sixth aspect of the present invention, there is provided a polishing apparatus for polishing a substrate, the polishing apparatus comprising: a polishing table having a polishing surface; a substrate holding apparatus for holding a substrate to be polished and pressing the substrate against the polishing surface; and the above dressing apparatus.

The above and other objects, features, and advantages of the present invention will be apparent from the following description when taken in conjunction with the accompanying drawings which illustrates preferred embodiments of the present invention by way of example.

DETAILED DESCRIPTION OF THE PREFERRED EMBODIMENTS

A polishing apparatus according to an embodiment of the present invention will be described below with reference to FIGS. 1 through 6B.

Figure 1:
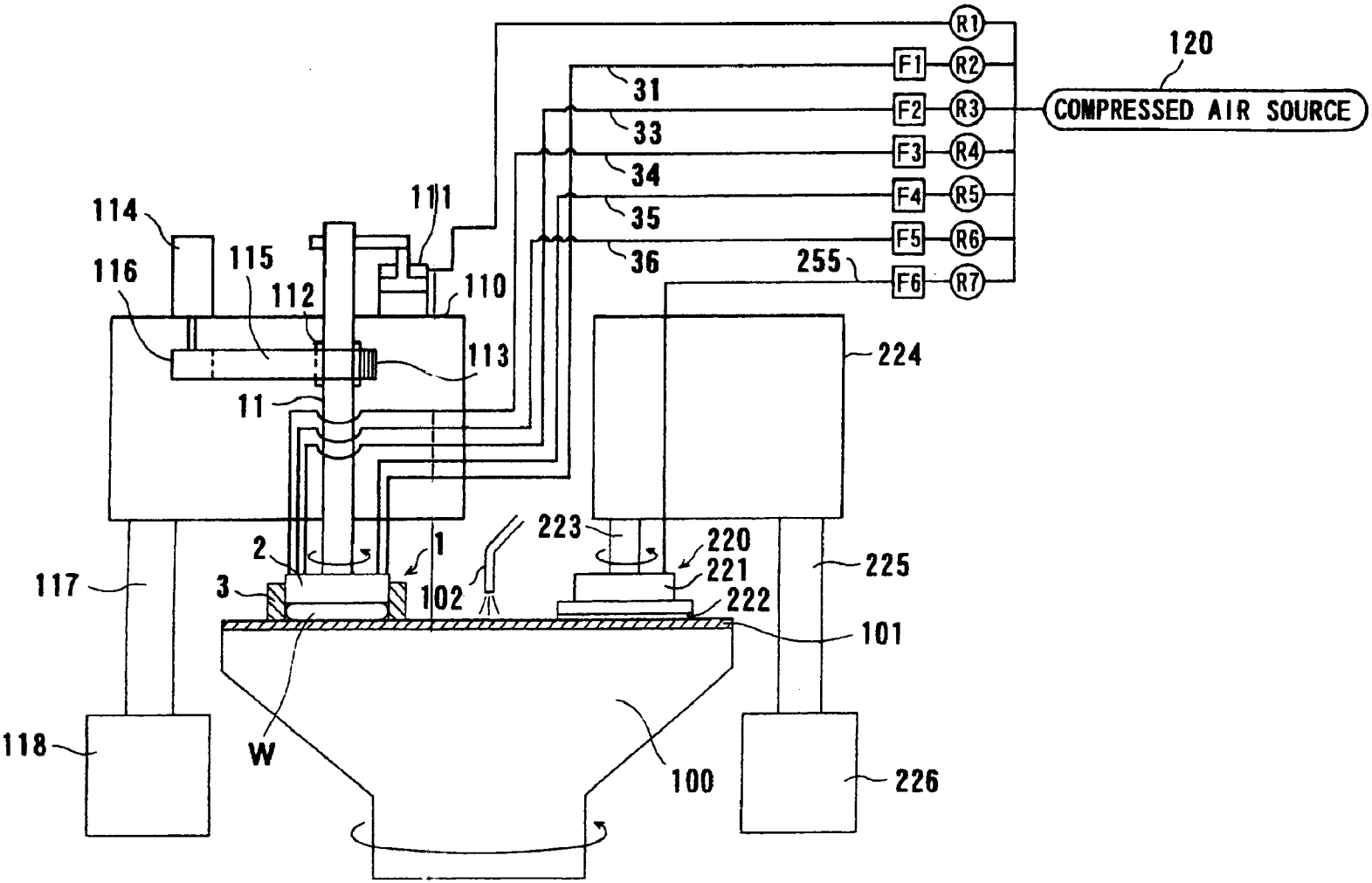
FIG. 1 is a cross-sectional view showing an entire structure of a polishing apparatus according to a first embodiment of the present invention.

As shown in FIG. 1, the polishing apparatus in the present embodiment comprises a polishing table 100 having a polishing pad 101 attached thereon, a top ring 1 for holding a substrate to be polished, such as a semiconductor wafer W, and pressing the substrate against the polishing pad 101, and a dresser 220 for dressing an upper surface of the polishing pad 101. Further, a polishing liquid supply nozzle 102 is disposed above the polishing table 100 for supplying a polishing liquid onto the polishing pad 101 on the polishing table 100.

Various kinds of polishing pads are available on the market. For example, some of these are SUBA800, IC-1000, and IC-1000/SUBA400 (two-layer cloth) manufactured by Rodel Inc., and Surfin xxx-5 and Surfin 000 manufactured by Fujimi Inc. SUBA800, Surfin xxx-5, and Surfin 000 are non-woven fabrics bonded by urethane resin, and IC-1000 is made of rigid foam polyurethane (single-layer). Foam polyurethane is porous and has a large number of fine recesses or holes formed in its surface. Non-woven fabrics, such as foam polyurethane or fabrics bonded by urethane resin, are formed in a circular form to constitute a polishing pad.

Although a polishing surface is constituted by the polishing pad in the present embodiment, the polishing surface is not limited to this polishing pad. For example, the polishing surface may be constituted by a fixed abrasive. The fixed abrasive is formed into a flat plate comprising abrasive particles fixed by a binder. With the fixed abrasive, a polishing process is performed by the abrasive particles which are being self-generated from the fixed abrasive. The fixed abrasive comprises abrasive particles, a binder, and pores. For example, abrasive particles of $CeO_2$, $SiO_2$, or $Al_2O_3$ having an average particle diameter of at most 0.5 $\mu$m are used, and a binder comprising a thermosetting resin such as epoxy resin or phenolic resin, or a thermoplastic resin such as MBS resin or ABS resin is used. Such a fixed abrasive forms a harder polishing surface. The fixed abrasive includes a fixed abrasive pad having a two-layer structure comprising a thin layer of a fixed abrasive and an elastic polishing pad attached to a lower surface of the layer of the fixed abrasive. The above IC-1000 may be used for another hard polishing surface.

Figure 2:
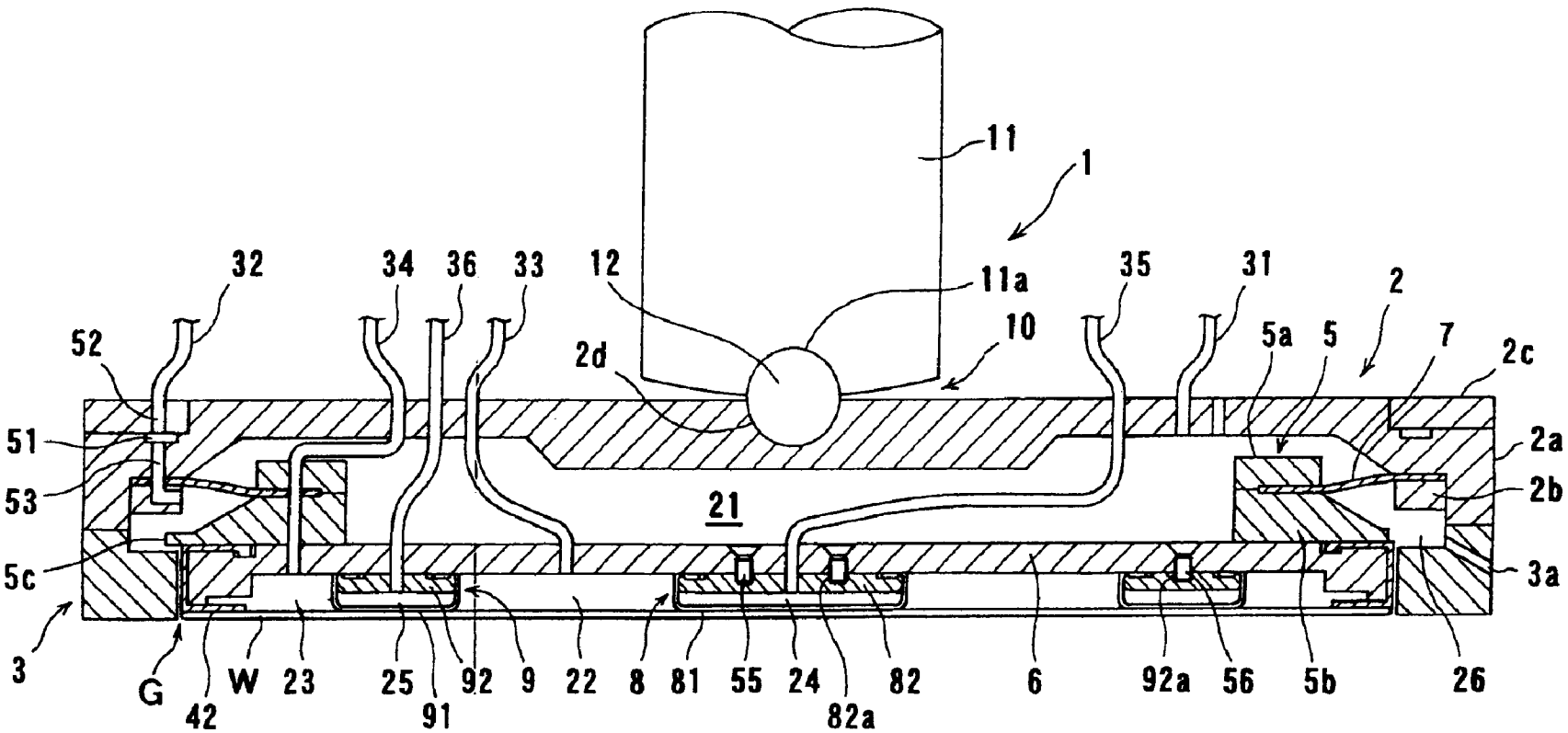
FIG. 2 is a vertical cross-sectional view showing a top ring in the polishing apparatus shown in FIG. 1.

As shown in FIG. 2, the top ring 1 is connected to a top ring drive shaft 11 by a universal joint 10. As shown in FIG. 1, the top ring drive shaft 11 is coupled to a top ring air cylinder 111 fixed to a top ring head 110. The top ring air cylinder 111 operates to vertically move the top ring drive shaft 11 to thus lift and lower the top ring 1 as a whole. The top ring air cylinder 111 also operates to press a retainer ring 3, fixed to a peripheral lower end of a top ring body 2, against the polishing pad 101 on the polishing table 100. The top ring air cylinder 111 is connected to a compressed air source (fluid supply source) 120 via a regulator R1. The regulator R1 regulates pressure of air supplied to the top ring air cylinder 111 for thereby adjusting a pressing force for pressing the polishing pad 101 with the retainer ring 3.

The top ring drive shaft 11 is connected to a rotary sleeve 112 by a key (not shown). The rotary sleeve 112 has a timing pulley 113 fixedly disposed therearound. A top ring motor 114 having a drive shaft is fixed to an upper surface of the top ring head 110. The timing pulley 113 is operatively coupled to a timing pulley 116 mounted on the drive shaft of the top ring motor 114 by a timing belt 115. When the top ring motor 114 is energized, the timing pulley 116, the timing belt 115, and the timing pulley 113 are rotated so as to rotate the rotary sleeve 112 and the top ring drive shaft 11 in unison with each other, thus rotating the top ring 1.

The top ring head 110 is supported on a top ring head shaft 117 which can be positioned. When the top ring head shaft 117 is rotated by a motor 118, the top ring 1 is angularly moved to a pusher (not shown) which serves as a transfer device for transferring a semiconductor wafer W between the polishing table 100 and the top ring 1.

For polishing the semiconductor wafer W, the semiconductor wafer W is held on a lower surface of the top ring 1, and pressed against the polishing pad 101 on the polishing table 100 by the top ring 1. The polishing table 100 and the top ring 1 are rotated to move the polishing pad 101 and the semiconductor wafer W relatively to each other, thus polishing the semiconductor wafer W. At this time, polishing liquid is supplied from the polishing liquid supply nozzle 102 onto the polishing surface of the polishing pad 101. For example, a suspension of fine polishing particles of silica ($SiO_2$) or the like in an alkali solution is used as the polishing liquid. Thus, the semiconductor wafer W is polished to a flat mirror finish by a combined effect of a chemical polishing effect attained by the alkali and a mechanical polishing effect attained by the polishing particles.

The dresser 220 comprises a dresser body 221 and a dressing member 222 fixed to a lower end of the dresser body 221. The dresser 220 is suspended from a dresser head 224 by a dresser drive shaft 223, and the dresser drive shaft 223 is coupled to a dresser air cylinder (not shown) fixedly mounted on the dresser head 224. The dresser air cylinder vertically moves the dresser drive shaft 223 to lift or lower the dresser 220 in its entirety, and also to move the dresser 220 to a given height from the polishing pad 101 on the polishing table 100.

The dresser drive shaft 223 has a rotating mechanism (not shown) which is the same as the rotating mechanism of the top ring drive shaft 11 described above. When the dresser drive shaft 223 is rotated, the dresser 220 is rotated in unison therewith. The dresser head 224 is supported by a dresser head shaft 225 which can be positioned. When the dresser head shaft 225 is rotated by a motor 226, the dresser 220 is angularly moved between the polishing table 100 and a standby position.

When the polishing surface of the polishing pad 101 is clogged with particles in he polishing liquid and ground-off particles of semiconductor material, a stable polishing performance of the polishing pad 101 cannot be obtained. Therefore, while the semiconductor wafer W is being polished or between polishing cycles, the dressing member 222 is pressed against the polishing surface while the dresser body 221 of the dresser 220 is rotated. At this time, a dressing liquid such as pure water is supplied from a dressing liquid supply nozzle (not shown) onto the polishing pad 101 on rotating polishing table 100. The polishing surface is thus slightly scraped at a removal rate ranging from 0.01 to 0.3 mm/h, thus preventing the polishing surface from being clogged with particles in the polishing liquid and ground-off particles of the semiconductor material. Thus, the polishing surface is regenerated to keep the polishing surface in a steady state at all times.

The top ring 1 of the substrate holding apparatus according to the present embodiment of the present invention will be described below. The top ring 1 constitutes a substrate holding apparatus according to the present invention. The substrate holding apparatus serves to hold a substrate to be polished, such as a semiconductor wafer, and to press the substrate against a polishing surface on a polishing table.

As shown in FIG. 2, the top ring 1 comprises the top ring body 2 in the form of a cylindrical housing with a storage space defined therein, and the retainer ring 3 fixed to the lower end of the top ring body 2. The top ring body 2 is made of a material having high strength and rigidity, such as metal or ceramic. The retainer ring 3 is made of highly rigid synthetic resin, ceramic, or the like.

The top ring body 2 comprises a cylindrical housing 2*a*, an annular pressurizing sheet support 2*b* fitted in the cylindrical housing 2*a*, and an annular seal 2*c* fitted over an outer circumferential edge of an upper surface of the cylindrical housing 2*a*. The retainer ring 3 is fixed to a lower end of the cylindrical housing 2*a* and has a lower portion projecting radially inwardly. The retainer ring 3 may be formed integrally with the top ring body 2.

The top ring drive shaft 11 is disposed above a central portion of the cylindrical housing 2*a*. The top ring body 2 is coupled to the top ring drive shaft 11 by the universal joint 10. The universal joint 10 has a spherical bearing mechanism by which the top ring body 2 and the top ring drive shaft 11 are tiltable with respect to each other, and a rotation transmitting mechanism for transmitting rotation of the top ring drive shaft 11 to the top ring body 2. The spherical bearing mechanism and the rotation transmitting mechanism transmit a pressing force and a rotating force from the top ring drive shaft 11 to the top ring body 2 while allowing the top ring body 2 and the top ring drive shaft 11 to be tilted with respect to each other.

The spherical bearing mechanism comprises a hemispherical concave recess 11*a* defied centrally in a lower surface of the top ring drive shaft 11, a hemispherical concave recess 2*d* defined centrally in an upper surface of the housing 2*a*, and a ball bearing 12 made of a very hard material such as ceramic and interposed between the hemispherical concave recesses 11*a* and 2*d*. The rotation transmitting mechanism comprises drive pins (not shown) fixed to the top ring drive shaft 11, and driven pins (not shown) fixed to the housing 2*a*. Each of the drive pins is held in engagement with each of the driven pins in such a state that the drive pins and the driven pins are vertically movable relatively to each other. Rotation of the top ring drive shaft 11 is transmitted to the top ring body 2 through the drive and driven pins. Even when the top ring body 2 is tilted with respect to the top ring drive shaft 11, the drive and driven pins remain in engagement with each other while a contact point is displaced, so that torque of the top ring drive shaft 11 can reliably be transmitted to the top ring body 2.

The top ring body 2 and the retainer ring 3 secured to the top ring body 2 jointly have a space defined therein, and within such a space, there are provided a seal ring 42 having a lower end surface which is brought into contact with a peripheral upper surface of the semiconductor wafer W, an annular holder ring 5, and a substantially disk-shaped chucking plate 6 for supporting the seal ring 42. The seal ring 42 has a radially outer edge clamped between the holder ring 5 and the chucking plate 6 secured to a lower end of the holder ring 5. The seal ring 42 extends radially inwardly so as to cover a lower surface of the chucking plate 6 near its outer circumferential edge. The seal ring 42 comprising an elastic membrane is made of a very strong and durable rubber material such as ethylene propylene rubber (ethylene-propylene terpolymer (EPDM)), polyurethane rubber, or silicone rubber. The semiconductor wafer W has a recess defined in an outer edge thereof, which is referred to as a notch or orientation flat, for recognizing or identifying an orientation of the semiconductor wafer. Therefore, the seal ring 42 should preferably extend radially inwardly from an innermost position of the recess such as a notch or orientation flat.

The chucking plate 6 may be made of metal. However, when a thickness of a thin film formed on a surface of a semiconductor wafer is measured by a method using eddy current in such a state that the semiconductor wafer to be polished is held by the top ring, the chucking plate 6 should preferably be made of a non-magnetic material, e.g., an insulating material such as fluororesin or ceramic.

A pressurizing sheet 7 comprising an elastic membrane extends between the holder ring 5 and the top ring body 2. The pressurizing sheet 7 has a radially outer edge clamped between the housing 2*a* and the pressurizing sheet support 2*b*, and a radially inner edge clamped between an upper portion 5*a* and a stopper 5*b* of the holder ring 5. The pressurizing sheet 7 is made of a very strong and durable rubber material such as ethylene propylene rubber (ethylene-propylene terpolymer (EPDM)), polyurethane rubber, or silicone rubber.

The top ring body 2, the chucking plate 6, the holder ring 5, and the pressurizing sheet 7 jointly define a hermetically sealed chamber 21 in the top ring body 2. As shown in FIG. 2, a fluid passage 31 comprising tubes and connectors communicates with the hermetically sealed chamber 21, and thus the hermetically sealed chamber 21 is connected to the compressed air source 120 via a regulator R2 connected to the fluid passage 31.

In a case where pressurizing sheet 7 is made of an elastic material such as rubber, if the pressurizing sheet 7 is clamped between the retainer ring 3 and the top ring body 2, then the pressurizing sheet 7 is elastically deformed as an elastic material, and a desired horizontal surface cannot be maintained on the lower surface of the retainer ring 3. In order to maintain the desired horizontal surface on the lower surface of the retainer ring 3, the pressurizing sheet 7 is clamped between the housing 2*a* of the top ring body 2 and the pressurizing sheet support 2*b* provided as a separate member in the present embodiment. The retainer ring 3 may vertically be movable with respect to the top ring body 2, or the retainer ring 3 may have a structure capable of pressing the polishing surface independently of the top ring body 2, as disclosed in Japanese laid-open Patent Publication No. 9-168964 and Japanese Patent Application No. 11-294503 (corresponding to U.S. patent application Ser. No. 09/652, 148). In such cases, the pressurizing sheet 7 is not necessarily fixed in the aforementioned manner.

Since there is a small gap G between an outer circumferential surface of the seal ring 42 and an inner circumferential surface of the retainer ring 3, the holder ring 5, the chucking plate 6, and the seal ring 42 attached to the chucking plate 6 can vertically be moved with respect to the top ring body 2 and the retainer ring 3, and hence are of a floating structure with respect to the top ring body 2 and the retainer ring 3.

The stopper 5*b* of the holder ring 5 has a plurality of teeth 5*c* projecting radially outwardly from an outer circumferential edge thereof. When the teeth 5*c* engage an upper surface of a radially inwardly projecting portion of the retainer ring 3 upon downward movement of the holder ring 5, the holder ring 5 is prevented from causing any further downward movement.

A cleaning liquid passage 51 in the form of an annular groove is defined in an upper surface of the housing 2*a* near its outer circumferential edge over which the seal 2*c* is fitted. The cleaning liquid passage 51 communicates with a fluid passage 32 via a through-hole 52 formed in the seal 2*c*, and is supplied with a cleaning liquid (pure water) via the fluid passage 32. A plurality of communication holes 53 are defined in the housing 2*a* and the pressurizing sheet support 2*b* in communication with the cleaning liquid passage 51. The communication holes 53 communicate with the small gap G defined between the outer circumferential surface of the seal ring 42 and the inner circumferential surface of the retainer ring 3. The fluid passage 32 is connected to a cleaning liquid source (not shown) through a rotary joint (not shown).

A central bag 8 and a ring tube 9, which are brought into contact with the semiconductor wafer W, are mounted on a lower surface of the chucking plate 6. In the present embodiment, as shown in FIG. 2, the central bag 8 having a circular contact surface is disposed centrally on the lower surface of the chucking plate 6, and the ring tube 9 having an annular contact surface is disposed radially outwardly of the central bag 8 in surrounding relation thereto. Specifically, the central bag 8 and the ring tube 9 are spaced at a predetermined interval.

The central bag 8 comprises an elastic membrane 81 which is brought into contact with the upper surface of the semiconductor wafer W, and a central bag holder 82 for detachably holding the elastic membrane 81 in position. The central bag holder 82 has threaded holes 82*a* defined therein, and is detachably fastened to a center of the lower surface of the chucking plate 6 by screws 55 screwed into the threaded holes 82*a*. The central bag 8 has a hermetically sealed chamber 24 defined therein by the elastic membrane 81 and the central bag holder 82. Similarly, the ring tube 9 comprises an elastic membrane 91 which is brought into contact with the upper surface of the semiconductor wafer W, and a ring tube holder 92 for detachably holding the elastic membrane 91 in position. The ring tube holder 92 has threaded holes 92*a* defined therein, and is detachably fastened to the lower surface of the chucking plate 6 by screws 56 screwed into the threaded holes 92*a*. The ring tube 9 has a hermetically sealed chamber 25 defined therein by the elastic membrane 91 and the ring tube holder 92. The elastic membrane 81 of the central bag 8 and the elastic membrane 91 of the ring tube 9 are made of a highly strong and durable rubber material such as ethylene propylene rubber (ethylene-propylene terpolymer (EPDM)), polyurethane rubber, or silicone rubber, as with the pressurizing sheet 7.

The semiconductor wafer W to be polished is held by the top ring 1 in such a state that the semiconductor wafer W is brought into contact with the seal ring 42, the elastic membrane 81 of the central bag 8, and the elastic membrane 91 of the ring tube 9. Therefore, the semiconductor wafer W, the chucking plate 6, and the seal ring 42 jointly define a space therebetween. This space is divided into a plurality of spaces by the central bag 8 and the ring tube 9. Specifically, a hermetically sealed chamber 22 is defined between the central bag 8 and the ring tube 9, and a hermetically sealed chamber 23 is defined radially outwardly of the ring tube 9.

Fluid passages 33 to 36, comprising tubes and connectors, communicate with the hermetically sealed chambers 22 to 25, respectively. The hermetically sealed chambers 22 to are connected to the compressed air source 120 via respective regulators R3 to R6 connected respectively to the fluid passages 33 to 36. The regulators R3 to R6 connected to the fluid passages 33 to 36 can respectively regulate pressures of pressurized fluids supplied to the hermetically sealed chambers 22 to 25. Alternatively, the hermetically sealed chambers 22 to may be connected to a vacuum source. Thus, it is possible to independently control pressures in the hermetically sealed chambers 22 to 25 or independently introduce atmospheric air or vacuum into the hermetically sealed chambers 22 to 25. The fluid passages 31, 33 to 36 are connected to the respective regulators R2 to R6 through a rotary joint (not shown) mounted on the upper end of the top ring head 110.

As shown in FIG. 1, the fluid passages 31, 33 to 36 connected to the respective hermetically sealed chambers 21 to 25 have respective flow meters (measuring device) F1 to F5 connected thereto for measuring flow rates of fluid supplied through the fluid passages to the hermetically sealed chambers 21 to 25. If there is a leakage from the hermetically sealed chambers 21 to 25, then a pressurized fluid flows in the fluid passages 31, 33 to 36 even after the hermetically sealed chambers 21 to 25 have been supplied with fluids under predetermined pressures. Therefore, by measuring a flow of pressurized fluid which is caused by a leakage, it is possible to detect leakage from the hermetically sealed chambers for thereby detecting a break of the elastic membranes 81, 91 and an assembling failure of the top ring 1. Specifically, the flow meters F1 to F5 detect a leakage from the hermetically sealed chambers 21 to 25 based on measured flow rates, respectively, and perform predetermined processes according to the leakage. Typically, the flow meters F1 to F5 can be arranged to perform a two-stage process. In the first stage, the flow meters F1 to F5 detect a small leakage caused by a small crack in the elastic membrane 81 of the central bag 8, the elastic membrane 91 of the ring tube 9, or the like and output an alarm signal. In the second stage, the flow meters F1 to F5 detect a greater leakage and output a fault signal.

Operation of the above top ring 1 will be described in detail below.

When the semiconductor wafer W is to be delivered to the polishing apparatus, the top ring 1 is moved to a position to which the semiconductor wafer W is transferred. Then, the central bag 8 and the ring tube 9 are supplied with a fluid under a predetermined pressure to bring lower end surfaces thereof into intimate contact with the semiconductor wafer W. Thereafter, the hermetically sealed chambers 22, 23 are connected to a vacuum source through the respective fluid passages 33, 34, for thereby developing a negative pressure in the hermetically sealed chambers 22, 23. Thus, the semiconductor wafer W is attracted by a suction effect of the hermetically sealed chambers 22, 23. Then, the top ring 1 is moved to a position above the polishing table 100 having the polishing surface (polishing pad 101) thereon in such a state that the semiconductor wafer W is attracted to the top ring 1. The retainer ring 3 holds an outer circumferential edge of the semiconductor wafer W so that the semiconductor wafer W is not removed from the top ring 1.

For polishing the semiconductor wafer W, the semiconductor wafer W is thus held on the lower surface of the top ring 1, and the top ring air cylinder 111 connected to the top ring drive shaft 11 is actuated to press the retainer ring 3 fixed to the lower end of the top ring 1 against the polishing surface on the polishing table 100 under a predetermined pressure. Then, pressurized fluids are respectively supplied to the hermetically sealed chambers 22 to 25 under respective pressures, thereby pressing the semiconductor wafer W against the polishing surface on the polishing table 100. The polishing liquid supply nozzle 102 then supplies polishing liquid onto the polishing pad 101. Thus, the semiconductor wafer W is polished by the polishing pad 101 with the polishing liquid being present between the lower surface, being polished, of the semiconductor wafer W and the polishing pad 101.

Local areas of the semiconductor wafer W that are positioned beneath the hermetically sealed chambers 22, 23 are pressed against the polishing pad 101 under respective pressures of the pressurized fluids supplied to the hermetically sealed chambers 22, 23. A local area of the semiconductor wafer W that is positioned beneath the hermetically sealed chamber 24 is pressed through the elastic membrane 81 of the central bag 8 against the polishing pad 101 under pressure of the pressurized fluid supplied to the hermetically sealed chamber 24. A local area of the semiconductor wafer W that is positioned beneath the hermetically sealed chamber 25 is pressed through the elastic membrane 91 of the ring tube 9 against the polishing pad 101 under pressure of the pressurized fluid supplied to the hermetically sealed chamber 25.

Therefore, polishing pressures acting on respective local areas of the semiconductor wafer W can be adjusted independently by controlling the respective pressures of the pressurized fluids supplied to the hermetically sealed chambers 22 to 25. Polishing rates depend on pressing forces applied to areas being polished. The pressing force is a pressure per unit area for pressing a substrate against the polishing surface. Since the pressures applied to the respective areas of the semiconductor wafer W can be controlled, polishing rates of the respective areas of the semiconductor wafer W can be controlled independently of each other. Therefore, even if thickness of the thin film to be polished on the surface of the semiconductor wafer W has a radial distribution, an entire surface of the semiconductor wafer W is prevented from being insufficiently polished or excessively polished.

Specifically, even if the thickness of the thin film to be polished on the surface of the semiconductor wafer W differs depending on radial positions on the semiconductor wafer W, pressure in a hermetically sealed chamber positioned over a thicker area of the thin film is made higher than pressure in a hermetically sealed chamber positioned over a thinner area of the thin film, or pressure in a hermetically sealed chamber positioned over a thinner area of the thin film is made lower than pressure in a hermetically sealed chamber positioned over a thicker area of the thin film. In this manner, a pressing force applied to the thicker area of the thin film is made higher than a pressing force applied to the thinner area of the thin film, thereby selectively increasing a polishing rate of the thicker area of the thin film. Consequently, an entire surface of the semiconductor wafer W can be polished exactly to a desired level irrespective of a film thickness distribution obtained at a time when the thin film is formed.

When the semiconductor wafer W is polished, the seal ring 42 is brought into close contact with the upper surface (reverse side) of the semiconductor wafer W, so that the pressurized fluid supplied to the hermetically sealed chamber 23 is prevented from flowing out to an exterior. For the same reason, even if the elastic membrane 81 of the central bag 8 and the elastic membrane 91 of the ring tube 9 have through-holes defined in their lower surfaces, pressurized fluids in the hermetically sealed chambers 24, 25 are prevented from flowing out to the exterior during a polishing process.

When polishing of the semiconductor wafer W is finished, the semiconductor wafer W is attracted under vacuum to the lower surface of the top ring 1 in the same manner as described above. At this time, the hermetically sealed chamber 21 is vented to the atmosphere or evacuated to develop a negative pressure therein. Then, the entire top ring 1 is moved to a position to which the semiconductor wafer W is to be transferred. Thereafter, a fluid such as compressed air or a mixture of nitrogen and pure water is ejected to the semiconductor wafer W via the fluid passages 33, 34 to release the semiconductor wafer W from the top ring 1. If the elastic membrane 81 of the central bag 8 and the elastic membrane 91 of the ring tube 9 have through-holes defined in their lower surfaces, then downwardly directed forces are applied to the semiconductor wafer W by the fluid flowing through these through-holes. Therefore, the semiconductor wafer W can be smoothly released from the top ring 1. After the semiconductor wafer W is released from the top ring 1, most of the lower surface of the top ring 1 is exposed. Therefore, the lower surface of the top ring 1 can be cleaned relatively easily after the semiconductor wafer W is polished and released.

Polishing liquid used to polish the semiconductor wafer W tends to flow through the gap G between the outer circumferential surface of the seal ring 42 and the inner circumferential surface of the retainer ring 3. If the polishing liquid is firmly deposited in the gap G, then the holder ring 5, the chucking plate 6, and the seal ring 42 are prevented from smoothly moving vertically with respect to the top ring body 2 and the retainer ring 3. To avoid such a drawback, a cleaning liquid (pure water) is supplied through the fluid passage 32 to the cleaning liquid passage 51. Accordingly, the pure water is supplied via the communication holes 53 to a region above the gap G, thus cleaning members defining the gap G to remove deposits of the polishing liquid. The pure water should preferably be supplied after a polished semiconductor wafer W is released and before a next semiconductor wafer to be polished is attracted to the top ring 1. It is also preferable to form a plurality of through-holes 3*a* in the retainer ring 3 so that all supplied pure water is discharged therethrough from the top ring 1 before the next semiconductor wafer is polished, as shown in FIG. 2. Furthermore, if a pressure buildup is developed in a space 26 defined between the retainer ring 3, the holder ring 5, and the pressurizing sheet 7, then it acts to prevent the chucking plate 6 from being elevated in the top ring body 2. Therefore, in order to allow the chucking plate 6 to be elevated smoothly in the top ring body 2, the through-holes 3*a* should preferably be provided for equalizing pressure in the space 26 with atmospheric pressure.

While the semiconductor wafer W is being polished, the flow meters F1 to F5 measure flow rates of fluids supplied via the fluid passages 31, 33 to 36 to the hermetically sealed chambers 21 to 25 to detect a leakage from the hermetically sealed chambers 21 to 25. In the present embodiment, the flow meters F1 to F5 are arranged to perform a two-stage process when a leakage occurs, as described above.

In the two-stage process, an alarm signal is outputted when a small leakage occurs. Since pressures in the hermetically sealed chambers can be maintained at preset levels regardless of the small leakage, a polishing process is continued even when the small leakage occurs. If a fault signal is outputted, then the polishing process with the top ring 1 is immediately stopped. Specifically, when a large leakage occurs, pressures in the hermetically sealed chambers cannot be maintained at preset levels, and also there is a strong possibility of damage to the semiconductor wafer W. Therefore, the polishing process should be instantaneously stopped. More specifically, rotation of the top ring 1 is stopped, the top ring 1 is elevated, and rotation of the polishing table 100 is also stopped. In a case where the polishing process is performed at the same time that a dressing process, described later on, is performed, rotation of the dresser 220 is also stopped, and the dresser 220 is elevated. The polishing process may immediately be stopped in response to issuance of the alarm signal.

When the polishing process is stopped due to a leakage from one of the hermetically sealed chambers, the elastic membrane which has caused the leakage is replaced or the top ring 1 is assembled again. In this case, the flow meters F1 to F5 are disposed in the respective fluid passages so as to immediately judge which one of the hermetically sealed chambers in the top ring has caused the leakage, and hence an operator can work on only necessary members quickly.

The hermetically sealed chambers defined in the top ring 1 include the hermetically sealed chambers 22, 23 sealed by the elastic membranes 81, 91 and the semiconductor wafer W. The flow meters F2, F3 disposed in the fluid passages 33, 34 connected to the hermetically sealed chambers 22, 23 can detect not only a leakage due to a crack in the elastic membranes 81, 91, but also a dislodgment of the semiconductor wafer W from the lower surface of the top ring 1. If the semiconductor wafer W is dislodged from the lower surface of the top ring 1, then a polishing process should immediately be stopped because there is a strong possibility of damage to the semiconductor wafer W. In such a case, since the flow meters F2, F3 detect a large leakage, the flow meters F2, F3 issue a fault signal, and hence the polishing apparatus is immediately stopped.

The hermetically sealed chambers 21 to 25 include the hermetically sealed chambers 21, 24, 25 fully closed by the elastic membranes 81, 91, and the hermetically sealed chambers 22, 23 sealed by the semiconductor wafer W, the seal ring 42, and the elastic membranes 81, 91. Inasmuch as the tendency of a leakage from these hermetically sealed chambers differs from chamber to chamber, individual thresholds may be set for alarm signals and fault signals to be outputted from the flow meters F1 to F5.

Figure 3:
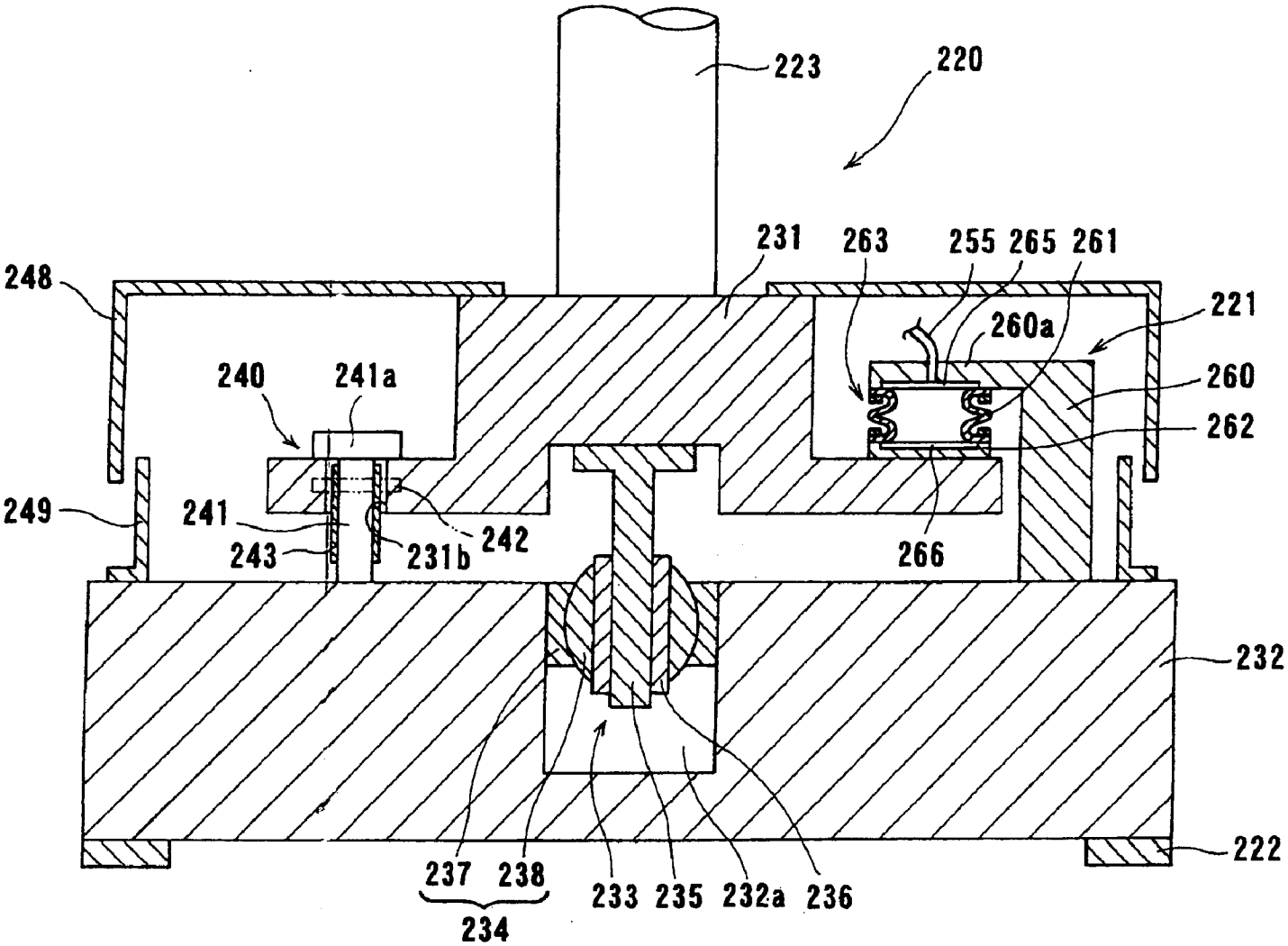
FIG. 3 is a vertical cross-sectional view showing a dresser in the polishing apparatus shown in FIG. 1, this view showing a state in which the dresser is lifted from a polishing table.
Figure 4:
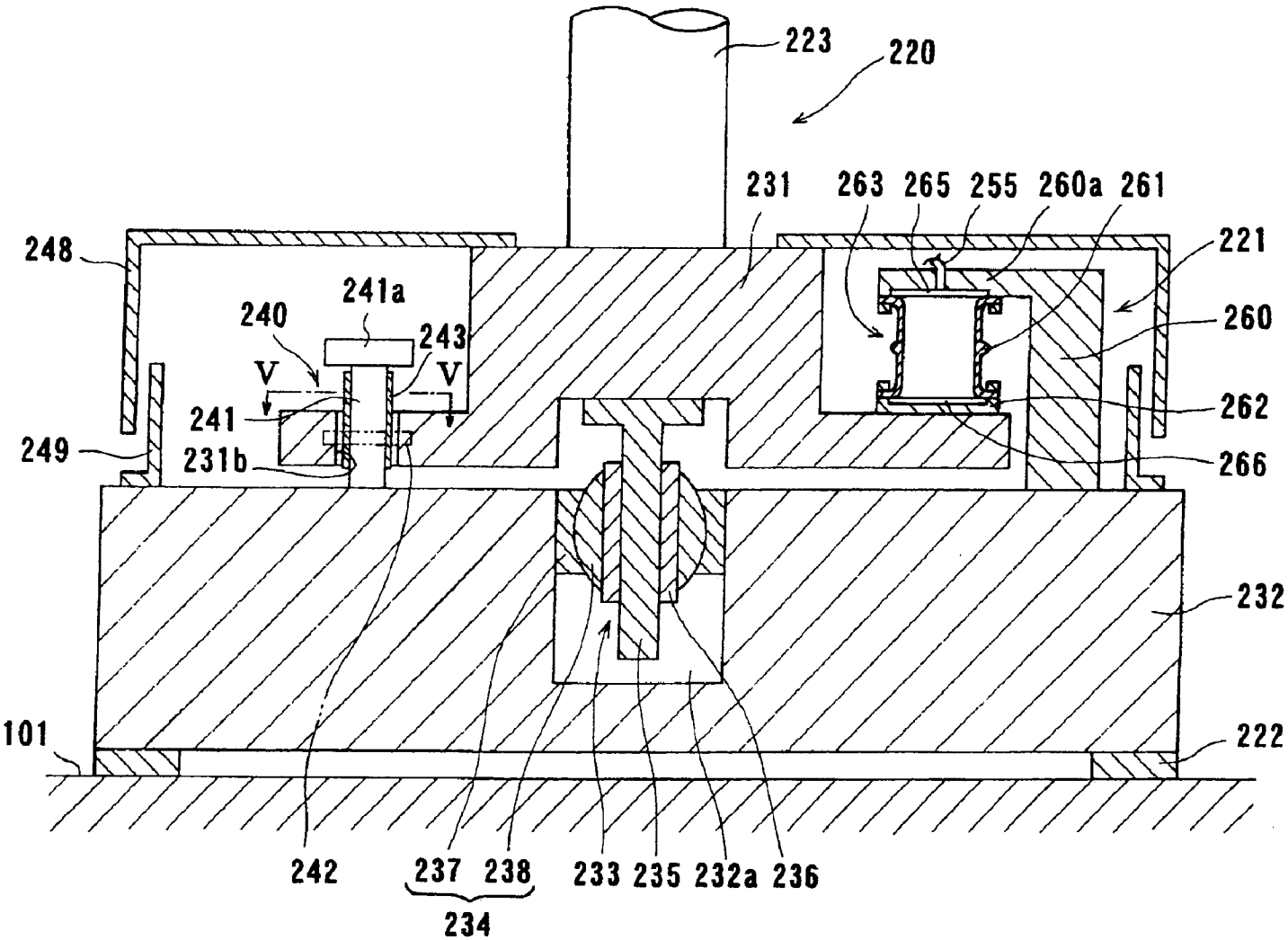
FIG. 4 is a vertical cross-sectional view of the dresser shown in FIG. 3, this view showing a state in which the dresser is in a dressing operation of a polishing surface.

The dresser 220 according to the present embodiment of the present invention will be described below. FIGS. 3 and 4 are vertical cross-sectional views showing the dresser 220 according to the present embodiment of the present invention. FIG. 3 shows a state in which the dresser 220 is lifted from the polishing surface, and FIG. 4 shows a state in which the dresser 220 performs dressing of the polishing surface.

As shown in FIGS. 3 and 4, the dresser 220 comprises a dresser body 221 connected to a dresser drive shaft 223, and a dressing member 222 fixed to the dresser body 221. The dressing member 222 may comprise a dressing member having diamond particles electrodeposited on its lower surface, a dressing member composed of ceramic such as SiC, or a dressing member composed of another material. The dressing member 222 may be of an annular shape or a disk shape.

The dresser body 221 comprises a dresser base 231 coupled to the dresser drive shaft 223, a disk-shaped dresser plate 232 which holds the dressing member 222, a gimbal mechanism 233 interconnecting the dresser base 231 and the dresser plate 232 so that the dresser plate 232 is tiltable with respect to the dresser base 231, and a rotation transmitting mechanism 240 for transmitting rotation of the dresser drive shaft 223 to the dresser plate 232. The dresser base 231 may be coupled to the dresser drive shaft 223 via a separate member.

The gimbal mechanism 233 is disposed in an upwardly open recess 232*a* defined centrally in an upper portion of the dresser plate 232. The gimbal mechanism 233 comprises a spherical slide bearing 234, a centering shaft 235 fixed to the dresser base 231, and a linear bearing 236 inserted between the spherical bearing 234 and the centering shaft 235. The spherical bearing 234 comprises a fixed member 237 fixed to the dresser plate 232 and having a hemispherical concave surface, and a substantially spherical movable member 238 slidably fitted to the hemispherical concave surface of the fixed member 237. The linear bearing 236 is inserted and fixedly positioned in the substantially spherical movable member 238. The centering shaft 235 fixed to the dresser base 231 is fitted in the linear bearing 236.

The centering shaft 235 is vertically movable with respect to the linear bearing 236, and the fixed member 237 is rotatable with respect to the linear bearing 236 and the movable member 238. Therefore, the spherical bearing 234 allows the dresser plate 232 to be tilted, and the linear bearing 236 allows the dresser plate 232 to be moved vertically, without causing the dresser plate 232 to be brought out of coaxial alignment with the dresser base 231.

Figure 5:
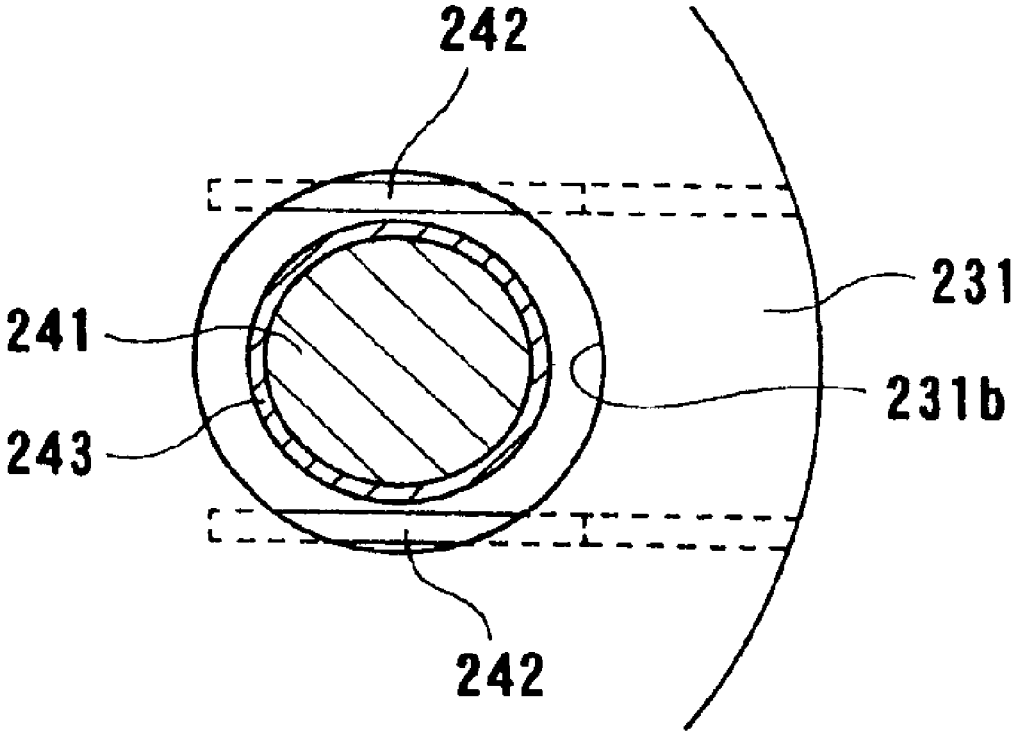
FIG. 5 is an enlarged cross-sectional view taken along line V—V of FIG. 4 as turned horizontally at 180°.

The rotation transmitting mechanism 240 has a plurality of torque transmitting pins 241 mounted on and fixed to the dresser plate 232 at angularly spaced intervals along a circumferential direction. The torque transmitting pins 241 extend vertically through respective through-holes 231*b* formed in an outer circumferential flange of the dresser base 231. FIG. 5 is an enlarged cross-sectional view of the dresser 220 shown in FIG. 4, which is a view as viewed from an arrow taken along line V—V of FIG. 4 and as turned horizontally at 180°. As shown in FIG. 5, two spaced pins 242 are horizontally disposed in the dresser base 231, one on each side of each of the torque transmitting pin 241, and extend partly through each of the through-holes 231*b*. A damper sleeve 243 made of rubber or the like is fitted over the torque transmitting pin 241. The torque transmitting pin 241 and the pins 242 are brought into engagement with each other through the damper sleeve 243.

When the dresser drive shaft 223 is rotated about its own axis, the dresser base 231 rotates in unison with the dresser drive shaft 223. Rotation of the dresser base 231 is transmitted to the dresser plate 232 through the engagement between the torque transmitting pin 241 and the pins 242. During dressing of the polishing surface of the polishing table 100, the dresser plate 232 is tilted so as to follow an inclination of the polishing surface. When the dresser plate 232 is tilted, since the torque transmitting pin 241 on the dresser plate 232 and the pins 242 on the dresser base 231 are brought into engagement with each other through point contact, the torque transmitting pin 241 and the pins 242 are held in reliable engagement with each other while varying points of contact, thus allowing rotational forces of the dresser drive shaft 223 to be transmitted reliably to the dresser plate 232.

The torque transmitting pins 241 have respective stoppers 241*a*, mounted on their upper ends, which are larger in size than inner diameters of the through-holes 231*b*. When the dresser body 221 is lifted, the stoppers 241*a* are brought into engagement with the upper surface of the dresser base 231, thus preventing the dresser plate 232 from being dislodged from the dresser base 231. The dresser base 231 and the dresser plate 232 have covers 248, 249 for preventing polishing liquid or dressing liquid from entering the dresser body 221, respectively.

The dresser plate 232 has an L-shaped arm 260 fixedly mounted thereon, and the L-shaped arm 260 has an upper portion projecting upwardly of the dresser base 231. The L-shaped arm 260 has a radially inward projection 260*a* supporting a tubular bellows-shaped resilient membrane 261 on its lower surface and a disk-shaped pressure plate 262 mounted on a lower end of the tubular bellows-shaped resilient membrane 261. The resilient membrane 261 and the pressure plate 262 jointly constitute an air bag (hermetically sealedchamber) 263. The air bag 263 and the L-shaped arm 260 should preferably be provided in a plurality of sets spaced at angularly equally spaced intervals along a circumferential direction on the dresser plate 232. In the present embodiment, the air bag 263 and the L-shaped arm 260 are provided in three sets at angularly equally spaced intervals of 120°. The tubular bellows-shaped resilient membrane 261 of the air bag 263 is made of a highly strong and durable rubber material such as ethylene propylene rubber (ethylene-propylene terpolymer (EPDM)), polyurethane rubber, silicone rubber, or the like. The pressure plate 262 is not fixed to the upper surface of the dresser base 231, but is held in slidable engagement therewith.

A fluid passage 255 comprising tubes and connectors or the like communicates with the air bag 263. The air bag 263 is connected to the compressed air source 120 via a regulator R7 connected to the fluid passage 255. Therefore, the regulator R7 connected to the fluid passage 255 can regulate pressure of pressurized fluid supplied to the air bag 263. Alternatively, the air bag 263 may be connected to a vacuum source. Thus, it is possible to control pressure in the air bag 263 or to introduce atmospheric air or vacuum into the air bag 263. The fluid passage 255 is connected to the regulator R7 through a rotary joint (not shown) mounted on an upper end of the dresser head 224.

Pressure in the air bag 263 can be adjusted to any desired pressure ranging from a positive pressure to a negative pressure. When a pressurized fluid such as compressed air is supplied through the fluid passage 255 to the air bag 263, the air bag 263 is inflated, thus applying upwardly directed forces to the dresser plate 232. Pressure of the pressurized fluid can be regulated by the regulator R7 to control a dressing load based on a balance between pressure of the pressurized fluid and weight of the movable dresser assembly (i.e., the dresser plate 232, the dressing member 222, the torque transmitting pins 241, the spherical slide bearing 234, the linear bearing 236, the L-shaped arm 260, and the cover 249).

Specifically, the movable dresser assembly has a total weight of about 12 kg. The dressing load can be controlled in a range of from about 0 N to about 120 N by a balance between the weight of the movable dresser assembly and positive pressure in the air bag 263. Because positive pressures can generally be controlled in a wider range and with greater ease than negative pressures, it is preferable to equalize the weight of the movable dresser assembly with a maximum dressing load that is required, and control the dressing load based on positive pressure in the air bag 263.

As shown in FIG. 1, the fluid passage 255 connected to the air bag 263 has a flow meter (measuring device) F6 connected thereto for measuring flow rates of fluid supplied through the fluid passage to the air bag 263. The flow meter F6 can detect a leakage from the air bag 263 based on a measured flow rate, and perform predetermined processes according to the leakage, as with the flow meters F1 to F5. In the present embodiment, the flow meter F6 is arranged to perform a two-stage process.

Figure 6B:
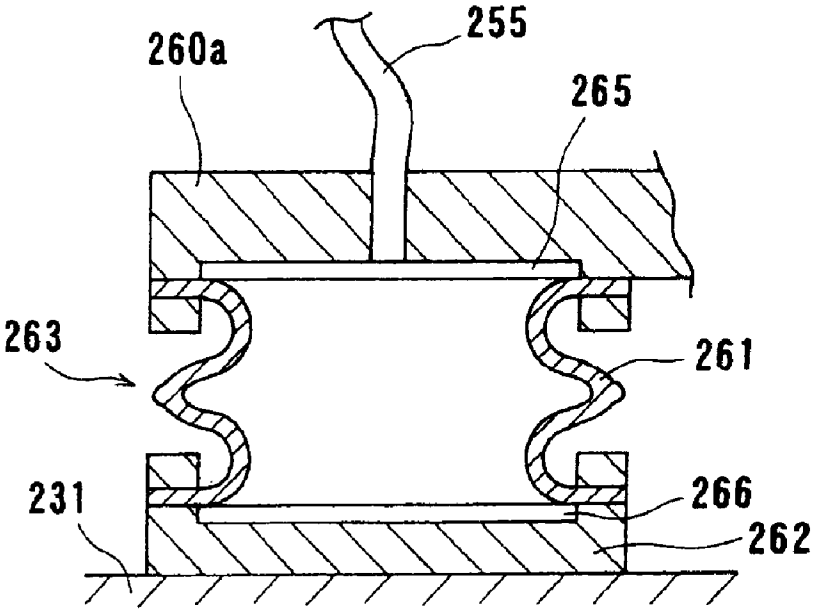
FIG. 6B is a cross-sectional view of the air bag shown in FIGS. 3 and 4, this view showing a state in which the air bag is deflated, i.e., no pressure is applied to the air bag.
Figure 6A:
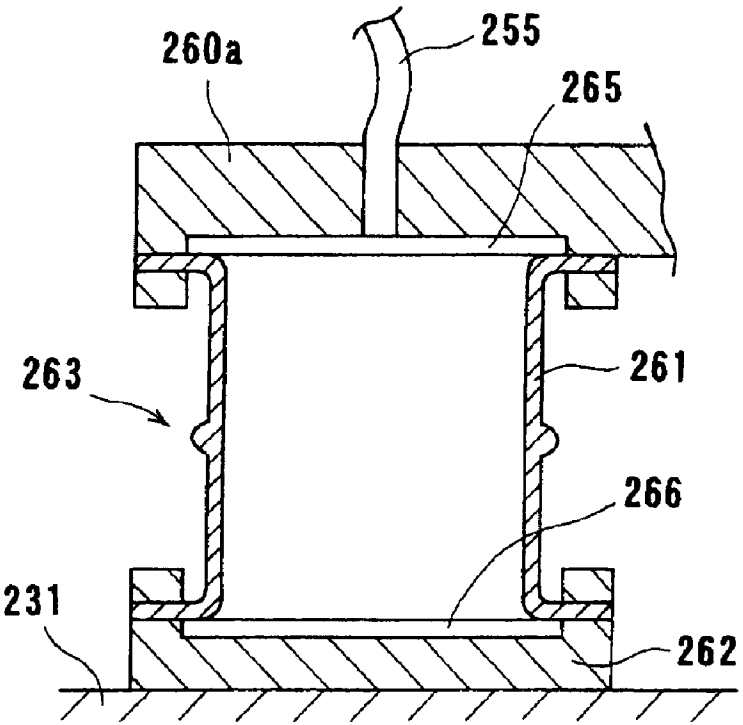
FIG. 6A is a cross-sectional view of an air bag shown in FIGS. 3 and 4, this view showing a state in which the air bag is inflated.

FIGS. 6A and 6B show a manner in which the air bag 263 shown in FIGS. 3 and 4 operates. FIG. 6A shows a state in which the air bag 263 is inflated, and FIG. 6B shows a state in which the air bag 263 is deflated, i.e., no pressure is applied to the air bag 263. In FIG. 6A, pressurized fluid is introduced into the air bag 263 to inflate the air bag 263, thus expanding the resilient membrane 261 to cause the pressure plate 262 to press the dresser base 231. Accordingly, an upwardly directed force is applied to the dresser plate 232. As a result, a dressing load applied to press the polishing surface by the movable dresser assembly is reduced. In FIG. 6B, no pressure is applied to the air bag 263 so as to deflate the air bag 263, thus contracting the resilient membrane 261. Therefore, the pressure plate 262 does not press the dresser base 231, and no upwardly directed force is applied to the dresser plate 232.

In order to accurately control an upwardly directed force applied to the dresser plate 232 with pressure supplied to the air bag 263, recesses 265 and 266 may be formed respectively in a lower surface of the projection 260*a* of the L-shaped arm 260 and an upper surface of the pressure plate 262 for keeping areas of upper and lower surfaces in the air bag 263 constant even when the resilient membrane 261 is somewhat flexed.

Operation of the dresser 220 described above will be described in detail below.

A dresser air cylinder (not shown) housed in the dresser head 224 is actuated to lower the dresser drive shaft 223 together with the dresser body 221 from the position shown in FIG. 3. At this time, the stoppers 241*a* are held in engagement with the upper surface of the dresser base 231. The dresser drive shaft 223 is lowered by a predetermined distance to bring the dressing member 222 into contact with the polishing surface of the polishing table 100. After the dressing member 222 contacts the polishing surface of the polishing table 100, only the dresser drive shaft 223 and the dresser base 231 are lowered, with a result that the stoppers 241*a* are disengaged from the dresser base 231. Further, the centering shaft 235 slides in the linear bearing 236, and the dresser 220 becomes in such a state shown in FIG. 4. Because the dresser drive shaft 223 is lowered until any flexing of the resilient membrane 261 is removed, areas of the upper and lower surfaces in the air bag 263 are kept constant by the recesses 265 and 266, regardless of slight wear of the polishing surface when the polishing surface is dressed.

With the state as shown in FIG. 4, the dresser drive shaft 223 is rotated about its own axis, and the dressing member 222 is brought into sliding contact with the polishing surface, thereby dressing the polishing surface. At this time, a dressing load applied to the polishing surface by the dressing member 222 is imposed only by the dresser plate 232 and parts fixed to the dresser plate 232, and hence such dressing load is relatively small. Specifically, in the present embodiment, the dressing load is imposed by the dresser plate 232, the dressing member 222, the torque transmitting pins 241, the spherical bearing 234, the linear bearing 236, the L-shaped member 260, and the cover 249, i.e., the weight of the movable dresser assembly, and hence such dressing load is small. Since the dressing load is small, an amount of material removed from the polishing surface when the polishing surface is dressed can be minimized.

If it is necessary to further reduce the dressing load, then the air bag 263 is connected to the compressed air source 120 and fluid pressure in the air bag 263 is regulated by the regulator R7 to provide a balance between the weight of the movable dresser assembly and the fluid pressure in the air bag 263 for thereby achieving a desired light dressing load.

If the above process is performed in order to apply a dressing load smaller than the weight of the movable dresser assembly, then a dressing load equal to the weight of the movable dresser assembly is temporarily applied to the polishing surface when the dressing member 222 is brought into contact with the polishing surface. In order to avoid this drawback, the dresser 220 should preferably be operated as follows:

With the state as shown in FIG. 3, the air bag 263 is connected to the fluid supply source and inflated to bring the dresser plate 232 to its uppermost position. Then, the dresser air cylinder housed in the dresser head 224 is actuated to lower the dresser drive shaft 223 and the dresser body 221 by a predetermined distance. At this time, a slight clearance is present between the lower surface of the dressing member 222 and the polishing surface. Thereafter, fluid pressure in the air bag 263 is adjusted to a certain pressure by the regulator R7 to further lower the dresser plate 232 until the lower surface of the dressing member 222 contacts the polishing surface, as shown in FIG. 4. Thus, a dressing load applied to the polishing surface is of a desired level. Since the lowering distance of the movable dresser assembly is small, the resilient membrane 261 is almost free from any flexing, and pressure-bearing areas of the upper and lower surfaces in the air bag 263 are kept constant by the recesses 265 and 266, regardless of slight wear of the polishing surface when the polishing surface is dressed. Fluid pressure in the air bag 263 before the dresser drive shaft 223 is lowered may be of such a level as to achieve a desired dressing load.

While the polishing surface is being dressed, the flow meter F6 measures a flow rate of fluid supplied via the fluid passage 255 to the air bag 263 to detect leakage from the air bag 263. In the present embodiment, the flow meter F6 is arranged to perform a two-stage process when leakage occurs, as described above. An alarm signal is outputted when a small leakage occurs, as in the case of the flow meters F1 to F5. The dressing process is continued even when the small leakage occurs. If a fault signal is outputted, then the dressing process with the dresser 220 is immediately stopped. The dresser 220 has a plurality of air bags 263, and FIGS. 3 and 4 show one of the air bags 263. If pressure in any one of the air bags 263 is not maintained at preset levels, then a dressing load is not balanced so as to damage the polishing surface. In the worst case, the dresser 220 itself may be broken. Specifically, rotation of the dresser 220 is stopped, the dresser 220 is elevated, and rotation of the polishing table 100 is also stopped. If the dressing process is performed at the same time that a polishing process is performed, then rotation of the top ring 1 is also stopped, and the top ring 1 is elevated. The dressing process may immediately be stopped in response to issuance of an alarm signal.

When the dressing process is stopped due to a leakage from one of the air bags 263, the elastic membrane 261 which has caused the leakage is replaced or the dresser 220 is assembled again. In this case, the flow meters are disposed in respective fluid passages connected to a plurality of air bags 263 so as to immediately judge which one of the air bags 263 in the dresser 220 has caused the leakage, and hence an operator can work only on necessary members quickly. In FIG. 1, only one fluid passage connected to one of the air bags 263 is shown, and the other passages and flow meters are not shown.

A leakage from the hermetically sealed chambers 21 to 25 in the top ring 1 and a leakage from the air bags 263 in the dresser 220 may be detected by not only the flow meters but also pressure gages. Since pressures in the hermetically sealed chambers 21 to 25 and the air bags 263 are maintained at constant levels by the regulators R2 to R7, flow meters should preferably be used to detect a small leakage or detect a leakage instantaneously.

For example, a layout and structure of the hermetically sealed chambers in the top ring 1 and a layout and structure of the air bag in the dresser 220 are not limited to the illustrated details, but may be modified as needed. While the polishing apparatus having a plurality of hermetically sealed chambers in the top ring 1 and a plurality of air bags in the dresser 220 has been described above, the polishing apparatus may have at least one hermetically sealed chamber and at least one air bag. The present invention is applicable to a top ring for holding an entire surface of a semiconductor wafer with one elastic membrane to polish the semiconductor wafer. In this case, if at least part of the hermetically sealed chamber is constructed of the semiconductor wafer, then it is possible to detect when the semiconductor wafer is slipped out of the top ring. For example, if at least one hole is defined in a surface of the elastic membrane which is brought into contact with the semiconductor wafer, it is possible to detect when the semiconductor wafer is slipped out of the top ring.

In the above embodiment, the flow meters detect a leakage in a two-stage process. However, the flow meters may detect a leakage in a single stage or three or more stages. A signal representative of such a detected leakage may be used as an alarm signal or a fault signal for operation of the polishing apparatus.

Although certain preferred embodiments of the present invention have been shown and described in detail, it should be understood that various changes and modifications may be made therein without departing from the scope of the appended claims.

What is claimed is:

1. A substrate holding apparatus for holding a substrate to be polished and pressing the substrate against a polishing surface, said substrate holding apparatus comprising:

a top ring body for holding a substrate;

a plurality of hermetically sealed chambers defined in said top ring body;

a fluid supply source for supplying a fluid under a positive pressure or a negative pressure to each of said plurality of hermetically sealed chambers to control pressure under which the substrate is pressed against the polishing surface;

a plurality of fluid passages respectively interconnecting said plurality of hermetically sealed chambers and said fluid supply source; and a plurality of measuring devices disposed in said plurality of fluid passages, respectively, for measuring a flow rate in said plurality of fluid passages, respectively.

2. The substrate holding apparatus according to claim 1, wherein at least one of said plurality of hermetically sealed chambers is partially defined by the substrate when held by said top ring body.

3. The substrate holding apparatus according to claim 1, wherein said plurality of measuring devices have individual thresholds for generating an alarm signal or a fault signal.

4. A polishing apparatus for polishing a substrate, comprising:

a polishing table having a polishing surface; and a substrate holding apparatus for holding a substrate to be polished and pressing the substrate against said polishing surface, said substrate holding apparatus including:

(i) a top ring body for holding the substrate, (ii) a plurality of hermetically sealed chambers defined in said top ring body, (iii) a fluid supply source for supplying a fluid under a positive pressure or a negative pressure to each of said plurality of hermetically sealed chambers to control pressure under which the substrate is pressed against said polishing surface;

a plurality of fluid passages respectively interconnecting said plurality of hermetically sealed chambers and said fluid supply source; and a plurality of measuring devices disposed in said plurality of fluid passages, respectively, for measuring a flow rate in said plurality of fluid, respectively.

5. The polishing apparatus according to claim 4, wherein at least one of said plurality of hermetically sealed chambers is partially defined by the substrate when held by said top ring body.

6. The polishing apparatus according to claim 4, wherein said plurality of measuring devices have individual thresholds for generating an alarm signal or a fault signal.

7. A method for polishing a substrate, comprising:

using a top ring to press a substrate against a polishing surface provided on a polishing table;

supplying a fluid under a positive pressure or a negative pressure to each of a plurality of hermetically sealed chambers, which are defined in said top ring, to control pressure under which said substrate is pressed against said polishing surface; and measuring a flow rate of said fluid in each of a plurality of fluid passages through which said fluid flows to each of said plurality of hermetically sealed chambers, respectively.

8. The method according to claim 7, further comprising:

detecting leakage from at least one of said plurality of hermetically sealed chambers based on a corresponding measured flow rate.

9. The method according to claim 8, further comprising:

stopping polishing of said substrate when said leakage from said at least one of said plurality of hermetically sealed chambers is detected.

10. The method according to claim 7, further comprising:

detecting dislodgment of said substrate from said top ring based on a corresponding measured flow rate.

* * * * *

UNITED STATES PATENT AND TRADEMARK OFFICE

CERTIFICATE OF CORRECTION

PATENT NO. : 6,957,998 B2
DATED : October 25, 2005
INVENTOR(S) : Tetsuji Togawa

It is certified that error appears in the above-identified patent and that said Letters Patent is hereby corrected as shown below:

Column 19,
Line 18, insert -- passages -- before “respectively”.

Signed and Sealed this

Twenty-fourth Day of January, 2006

JON W. DUDAS
*Director of the United States Patent and Trademark Office*